US006742419B2

(12) United States Patent
Chartier et al.

(10) Patent No.: US 6,742,419 B2
(45) Date of Patent: Jun. 1, 2004

(54) PIVOTING JAW PIPE WRENCH

(75) Inventors: Glen R. Chartier, Avon Lake, OH (US); David L. Machovina, Elyria, OH (US); Chris W. Mandell, Westlake, OH (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/144,122

(22) Filed: May 10, 2002

(65) Prior Publication Data

US 2003/0209109 A1 Nov. 13, 2003

(51) Int. Cl.[7] ..... B25B 13/28
(52) U.S. Cl. ..... 81/99; 81/111
(58) Field of Search ..... 81/98, 99, 186, 81/111, 92–94, 97

(56) References Cited

U.S. PATENT DOCUMENTS

| | | | | |
|---|---|---|---|---|
| 460,230 A | * | 9/1891 | Gunnarson | 81/98 |
| 1,442,351 A | | 1/1923 | Martin | |
| 1,445,211 A | | 2/1923 | Gore | |
| 2,028,406 A | | 1/1936 | Mead | |
| 2,441,144 A | | 5/1948 | Gregory | |
| 2,559,973 A | | 7/1951 | Kunz | |
| D164,505 S | | 9/1951 | Larson | |
| 2,742,808 A | | 4/1956 | Haberle | |
| D184,451 S | | 2/1959 | Mullin | |
| 2,875,659 A | | 3/1959 | Haberle | |
| 4,534,245 A | * | 8/1985 | Rossmann | 81/111 |
| 5,251,518 A | | 10/1993 | Woo | |

FOREIGN PATENT DOCUMENTS

WO WO 01/19570 A1 3/2001

OTHER PUBLICATIONS

*Photocopy #1*—Undated photocopy of a pipe wrench commercially available prior to 2000, Weil, Adjustamatic, 10.
*Photocopy #2*—Undated photocopy of the opposite side of the wrench in Photocopy #1, Weil, Adjustamatic, 10.

* cited by examiner

*Primary Examiner*—D. S. Meislin
(74) *Attorney, Agent, or Firm*—Fay, Sharpe, Fagan, Minnich & McKee

(57) ABSTRACT

A pivoting jaw pipe wrench comprises a fixed jaw including a plurality of discrete teeth, each for a different one of a plurality of pipes having different diameters. A pivotal jaw member has first and second jaw faces at an obtuse angle to one another and displaceable toward and away from the fixed jaw, whereby a pipe of given diameter to be gripped by the wrench is cradled between the first and second jaw surfaces and engaged by the one of the discrete teeth provided on the arcuate jaw for the pipe of given diameter.

22 Claims, 15 Drawing Sheets

PIVOTING JAW PIPE WRENCH

BACKGROUND OF THE INVENTION

This invention relates to the art of pipe wrenches and more particularly, to improvements in pivoting jaw pipe wrenches.

Pivoting jaw pipe wrenches are known as shown, for example, in U.S. Pat. No. 2,028,406 to Mead and U.S. Pat. No. 2,559,973 to Kunz. Such wrenches typically include a handle having a fixed toothed jaw at one end thereof and a toothed jaw member pivotally mounted on the one end for displacement toward and away from the fixed jaw. The pivotal jaw member has teeth thereon which are cooperable with the teeth on the fixed jaw to grip a pipe or other workpiece therebetween, and the pivotal jaw is spring biased toward the fixed jaw to provide a closing force against the pipe or workpiece therebetween. In the Mead patent, the teeth on the fixed jaw extend in an arcuate path therealong and the pivotal jaw is provided with two sets of teeth which are at an obtuse angle relative to one another and which are spaced apart along the jaw. Each set of teeth on the pivotal jaw is cooperable with a different portion of the teeth on the fixed jaw to grip a square or round object therebetween. In the Kunz patent, the teeth on the fixed jaw extend along an arcuate face thereof and the pivotal jaw comprises a pair of legs at substantially right angles to one another and provided with corresponding sets of teeth. A pipe to be gripped by the wrench is cradled between the legs of the pivotal jaw and is urged against the fixed jaw to provide three point contact between the wrench jaws and pipe.

Pivoting jaw wrenches are desirable in that they are quickly applied to a workpiece to be gripped and turned, such as a pipe or pipe coupling and are self-adjusting to the size of the workpiece. However, the gripping capability of such wrenches is compromised when a large range of pipe sizes are required to be gripped while limiting the rotational swing of the pivotal jaw to 90° to facilitate operability of the wrench. In this respect, a large range of pipe sizes and the limitation of a 90° swing of the pivotal jaw results in undesirable slippage between the wrench and pipe in connection with the turning of larger sizes of pipe such as 1½ inches to 2 inches and larger diameter pipe. Further in this respect, a line from the pivot axis of the pivotal jaw to a given point on the arcuate jaw face and from the latter point through the vertex between the sets of teeth on the pivotal jaw provides a camming angle for a given diameter pipe and, in many pivoting jaw wrenches heretofore provided, the camming angle becomes unfavorable on the larger sizes of pipes which results in inefficient gripping performance, slippage and potential damage to the workpiece as well as the teeth on the jaws of the wrench.

SUMMARY OF THE INVENTION

In accordance with the present invention, a pivoting jaw pipe wrench is provided by which improved gripping performance is achieved with respect to a large range of pipe sizes which could not be satisfactorily accommodated in a single pivoting jaw wrench heretofore available. More particularly in this respect, improved gripping performance is achieved by providing a discrete tooth on the fixed jaw for each different size pipe to be gripped by the wrench while maintaining a functional pivot angle of 90° for the pivotal jaw. With regard to the latter, the working angle for the wrench is 90° and the actual angle is about 98° to provide an allowance for over travel. Further, an optimum camming angle is maintained for a given discrete tooth and pipe size combination and, preferably, each discrete tooth has a preferred included angle and preferred rake and relief angles relative to a diametrical line through the pipe and the apex of the tooth. The provision of a discrete tooth for each different pipe diameter together with a preferred camming angle for the tooth results in improved gripping performance relative to similar wrenches heretofore available, and the provision of a specific orientation of the tooth relative to the center of the corresponding pipe to be gripped and specific rake and relief angles for the tooth further improves the gripping performance.

In connection with a series of pipes having nominal diameters between ⅜ inch and 2 inches, and a pivotal jaw having a working pivot angle of displacement of 90° between the closed and open positions thereof, an improved gripping performance is achieved with a camming angle maintained between 90° and 150° for each of the discrete teeth provided on the arcuate jaw face for the different diameter pipes. Further, optimum gripping performance is realized when the discrete teeth for camming angles between 131° and 150° have an included angle of 90°, a relief angle of 40° and a rake angle of −40°. Likewise, optimum gripping performance is achieved when the discrete teeth providing camming angles between 90° and 130° have an included angle of 55°, a relief angle of 25°, and a rake angle of 10°. An acceptable range for each of the included, relief and rake angles is ±5°.

It is accordingly an outstanding object of the present invention to provide a pivoting jaw pipe wrench which accommodates a large range of pipe sizes and provides improved gripping performance with respect thereto relative to pivoting jaw pipe wrenches heretofore available.

Another object is the provision of a wrench of the foregoing character wherein the fixed jaw face comprises a plurality of discrete teeth therealong, one for each different size pipe to be accommodated.

Still another object is the provision of a wrench of the foregoing character wherein the camming angle for each discrete tooth with the corresponding pipe gripped between the latter tooth and the pivotal jaw member is between 90° and 150°.

A further object is the provision of a wrench of the foregoing character wherein each of the discrete teeth has a specific orientation, included angle, rake angle, and relief angle relative to the pipe corresponding thereto when the pipe is gripped by the wrench.

Yet another object is the provision of a wrench of the foregoing character wherein, for camming angles greater than 130°, a discrete tooth has a 90° included angle, a relief angle of 40°, and a rake angle of −40°, and, for camming angles between 90° and 130°, a discrete tooth has an included angle of 55°, a relief angle of 25°, and a rake angle of 10°, with each angle having an acceptable range of ±5°.

BRIEF DESCRIPTION OF THE DRAWINGS

The foregoing objects, and others, will be in part be obvious and in part pointed out more fully hereinafter in conjunction with the written description of preferred embodiments illustrated in the accompanying drawings in which.

DESCRIPTION OF PREFERRED EMBODIMENTS

Figure 1:
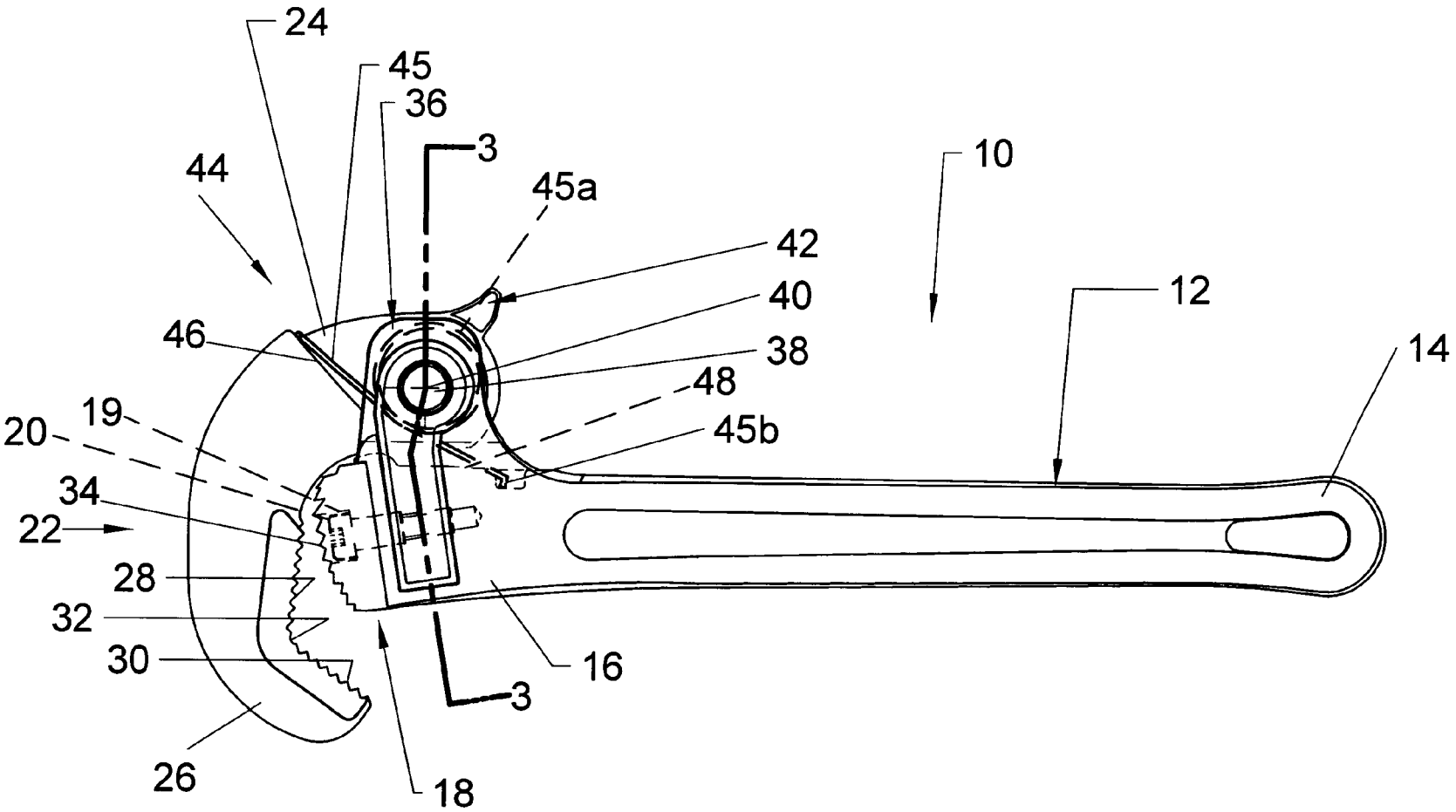
FIG. 1 is a side elevation view of a pivoting jaw pipe wrench in accordance with the invention and showing the pivotal jaw closed.
Figure 2:
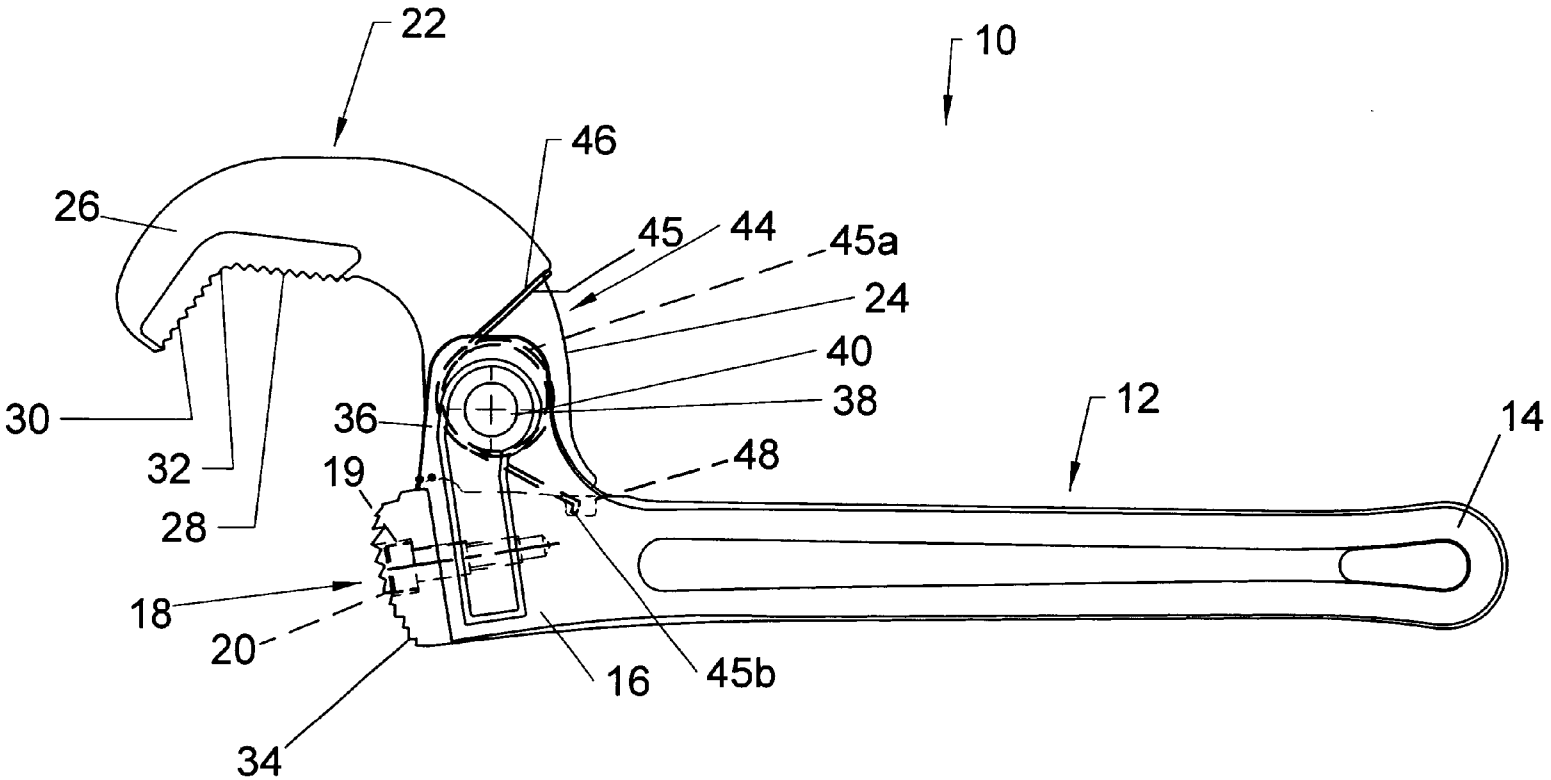
FIG. 2 is a side elevation view similar to FIG. 1 and showing the pivotal jaw open.
Figure 3:
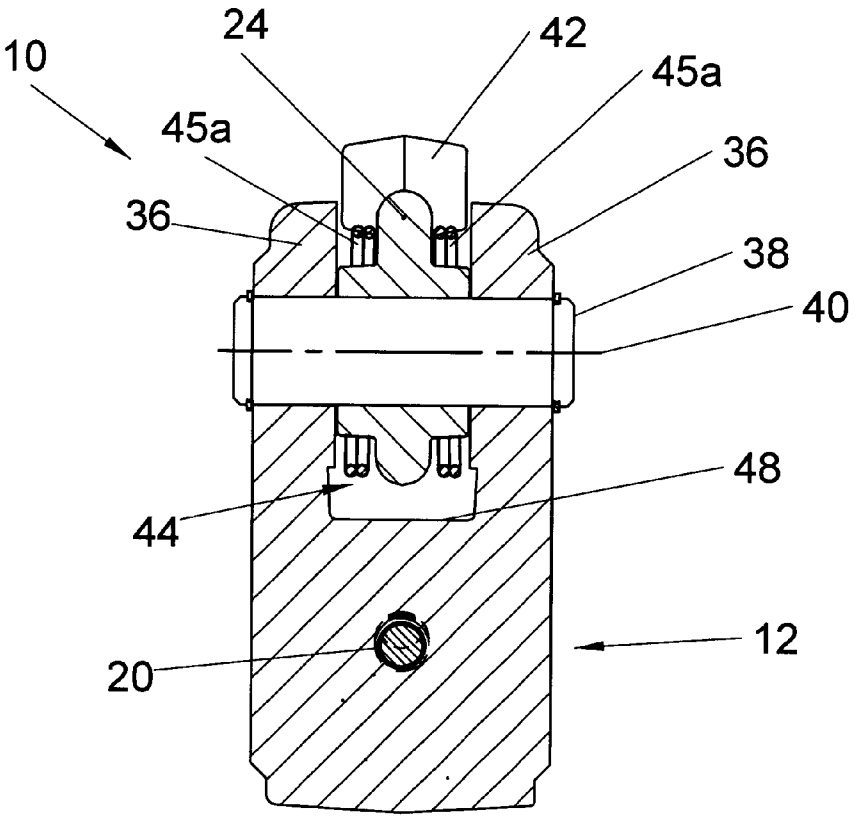
FIG. 3 is a sectional elevation view of the wrench taken along line 3—3 in FIG. 1.

Referring now in greater detail to the drawings, wherein the showings are for the purpose of illustrating preferred embodiments of the invention only and not for limiting the invention, FIGS. 1–4 illustrate a pivoting jaw pipe wrench 10 in accordance with the invention and which includes a handle 12 having longitudinally opposite ends 14 and 16 and an arcuate fixed jaw at end 16 which, in the illustrated embodiment, is provided by heel jaw member 18 which is described in greater detail hereinafter and which includes a stepped bore 19 therethrough by which it is mounted on handle 12 by a threaded fastener 20. Wrench 10 further includes a pivotal jaw member 22 having a mounting end 24 and a jaw end 26 provided with first and second linear jaw faces having teeth 28 and 30, respectively. The jaw faces are at an angle to one another which can be from 90° to 130° and which is nominally 120° and, preferably, 119° to accommodate gripping hex pipe unions. Teeth 28 and 30 are of standard shape and size for pipe wrenches, extend along the corresponding jaw face from the vertex 32 therebetween, and face inwardly of end 16 of handle 12. As will be described in greater detail hereinafter, jaw member 18 includes an arcuate jaw face 34 comprising a plurality of teeth, not designated numerically in FIGS. 1 and 2, and which extend laterally therealong and face outwardly of end 16 of the wrench handle.

End 16 of handle 12 includes laterally outwardly extending mounting arms 36 which are spaced apart to receive mounting end 24 of jaw member 22 therebetween, and the latter jaw member is pivotally mounted on handle 12 by a pin 38 extending therethrough and through mounting arms 36 and which provides a pivot axis 40 for jaw member 22. Jaw member 22 is adapted to be pivoted from the closed position shown in FIG. 1 to the open position shown in FIG. 2 by means of a projection 42 on mounting end 24 thereof and which is adapted to be engaged by the thumb of a person using the wrench to displace jaw member 22 clockwise in FIG. 1 about axis 40 to the open position thereof. A torsion spring 44 spans mounting end 24 of jaw member 22 and has a pair of legs 45 on opposite sides thereof engaging against a shoulder 46 on the jaw member. The legs have central portions 45*a* which circumscribe pin 38, and the legs terminate in ends 45*b* engaging surface 48 of the handle at the bottom of mounting legs 36. Accordingly, it will be appreciated that the spring biases jaw member 22 counterclockwise about axis 40 toward the closed position shown in FIG. 1.

Figure 4:
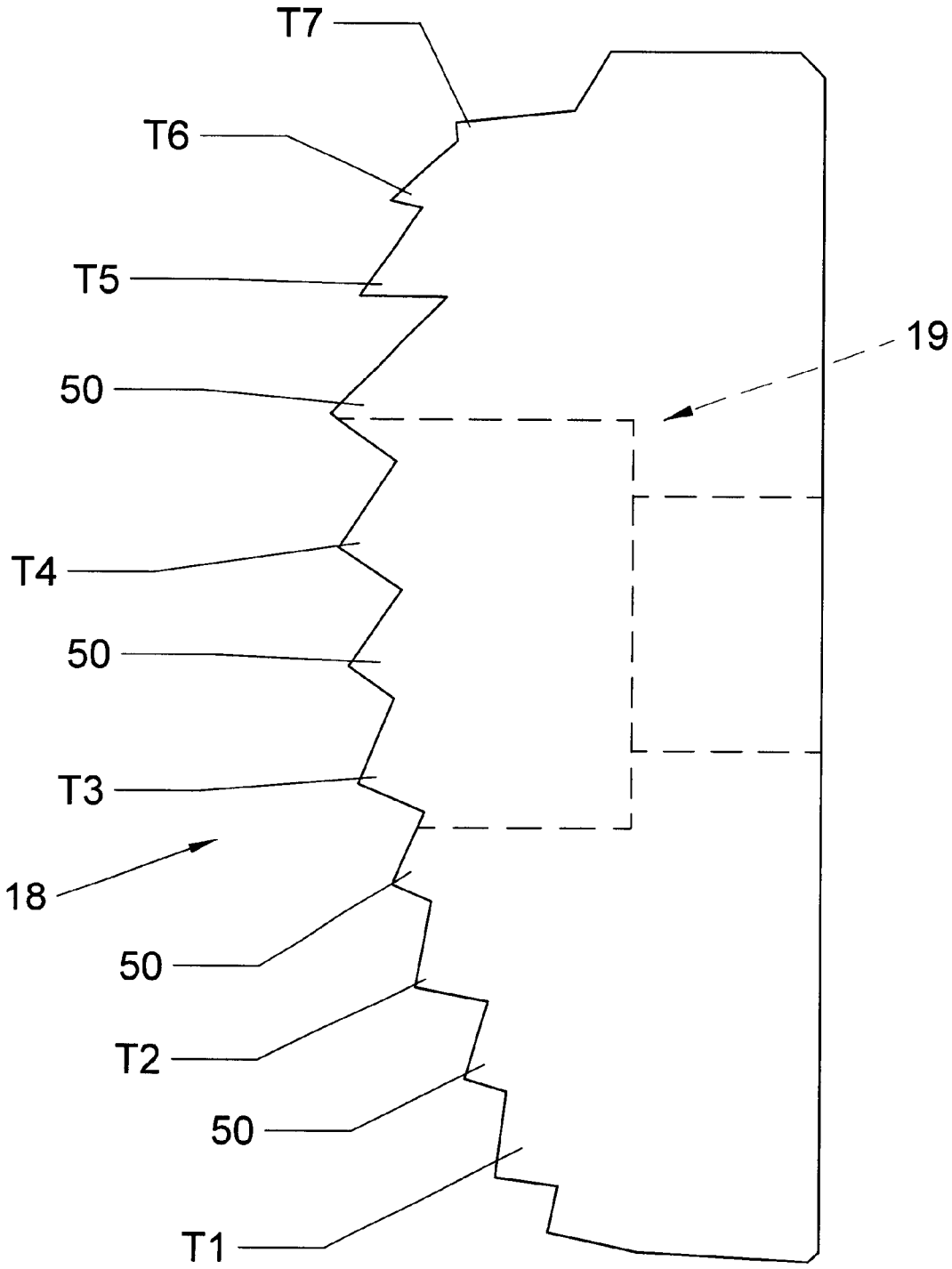
FIG. 4 is an enlarged side elevation view of the heel jaw component of the wrench.

Wrench 10 is adapted to grip any one of a plurality of pipes having nominal diameters of ⅜ inch, ½ inch, ¾ inch, 1 inch, 1¼ inches, 1½ inches, and 2 inches is adapted to grip straight, cylindrical pipe fittings for all of the latter pipe sizes up to and including 1½ inch pipe. As will become apparent hereinafter, each different size pipe is gripped between teeth 28 and 30 of pivotal jaw member 22 and a discrete tooth on arcuate jaw face 34 of jaw member 18 provided for each of the different size pipes. More particularly in this respect, as shown in FIG. 4 of the drawing, arcuate jaw face 34 of jaw member 18 is provided therealong with discrete teeth T1, T2, T3, T4, T5, T6, and T7 respectively for nominal pipe sizes of ⅜ inch, ½ inch, ¾ inch, 1 inch, 1¼ inches, 1½ inches, and 2 inches. In the preferred embodiment of wrench 10, tooth T7 also accommodates gripping a 1½ inch pipe fitting. While it is not necessary to provide any additional teeth on jaw member 18 other than the discrete teeth T1–T7, it is preferred to provide additional teeth 50 between adjacent ones of the discrete teeth T1–T5 to promote the gripping capability of the wrench with regard to pipe fittings, rod and other objects and workpieces in addition to the series of pipes. While reference herein is with regard to the foregoing nominal pipe sizes, it will be noted that the following descriptions regarding discrete tooth location, orientation, camming angles, and rotational angles are based on the OD dimensions of the pipes. While the latter are known, they are set forth here for convenience and are 0.675 inch for ⅜ inch pipe, 0.840 inch for ½ inch pipe, 1.050 inches for ¾ inch pipe, 1.315 inches for 1 inch pipe, 1.660 inches for 1¼ pipe, 1.900 inches for 1½ inch pipe, 2.375 inches for 2 inch pipe, and 2.530 inches for 1½ pipe fittings.

As mentioned hereinabove, it is desired to limit the working pivotal displacement of the jaw member 22 to a total of 90° to facilitate manual displacement of the pivoted jaw, and it is also desired to accommodate the series of different pipe sizes within the latter pivotal range while optimizing the gripping performance of the wrench with respect to each of the different pipe sizes. In accordance with the invention, this is achieved by first locating the position of the discrete tooth for the largest workpiece to be accommodated on heel jaw 18 and then locating the position of the discrete tooth for the smallest workpiece on the heel jaw. Then, the position of the discrete tooth for each of the other pipes in the series is located such that all of the pipes are accommodated within the 90° pivot limitation. A discrete tooth is then positioned at each of the locations to contact the corresponding pipe in such a manner as to optimize gripping thereof.

Figure 5:
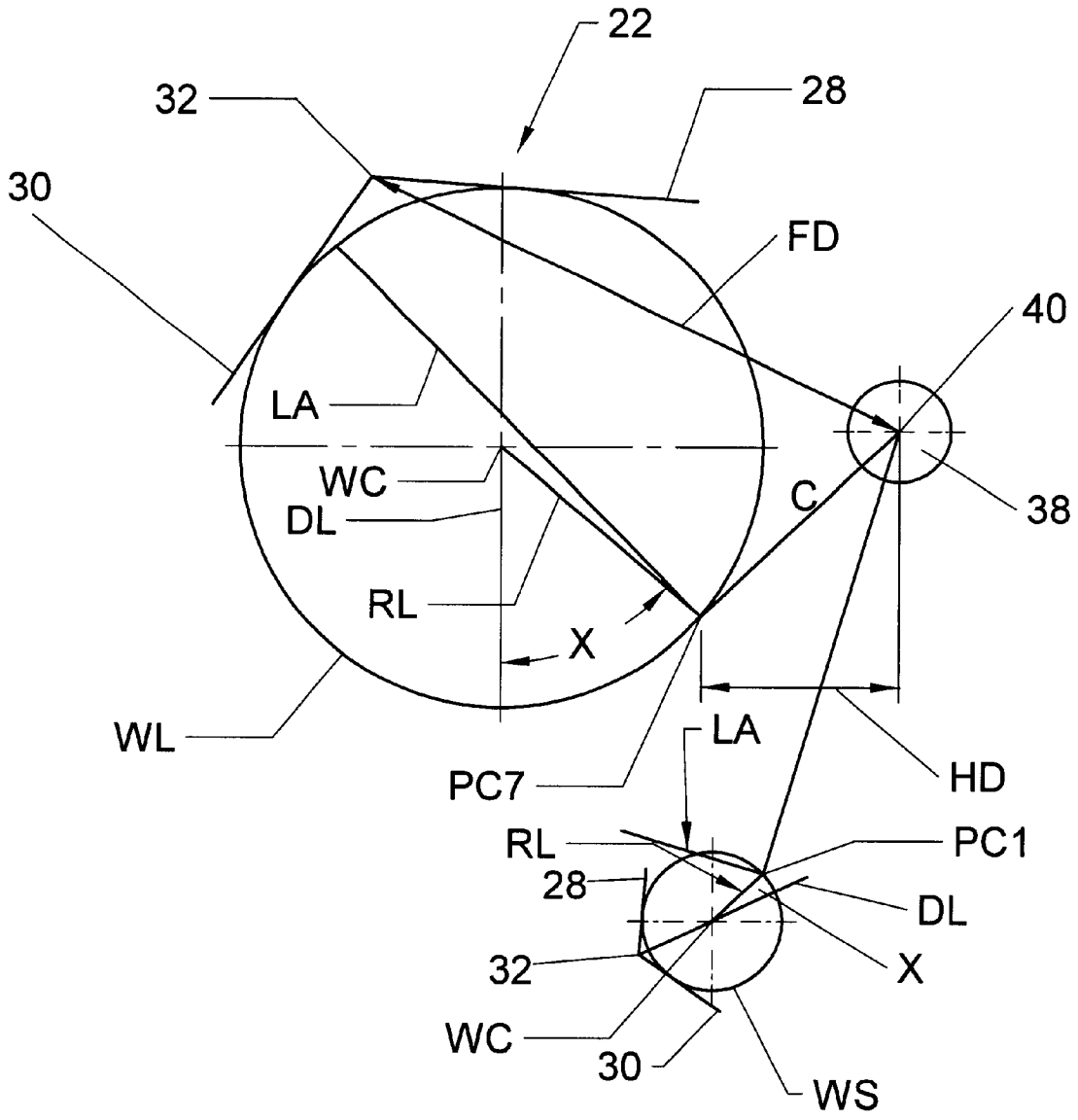
FIG. 5 is a schematic illustration of the locations of the discrete teeth on the heel jaw for the largest and smallest diameter workpieces.

As will be appreciated from FIG. 5 in connection with the embodiment disclosed herein, the locations of the points of contact for the largest diameter and smallest diameter workpiece, respectfully designated as PC7 and PC1, are determined as follows. As mentioned above, the largest diameter workpiece WL to be accommodated by wrench 10 is a 1½ inch pipe fitting which has an OD of 2.530 inches. As further mentioned above, predetermined parameters for the wrench include a maximum working pivot angle of 90° for jaw member 22 and an obtuse angle of 119° between the jaw faces of the pivotal jaw. Other preferred parameters include a camming angle between 90° and 150°, the location of the line of action LA between the workpiece center WC and pivot axis 40 of jaw 22, and an angle x of between 5° and 30° between a diametrical line DL through the workpiece center and vertex 32 of jaw member 22 and a radial line RL between the workpiece center and point of contact PC7. All of these parameters cooperatively optimize the gripping performance of the wrench. With regard to the line of action LA, it is always perpendicular to the line between the point of contact and pivot axis 40. Further, the offset of the line of action from workpiece center WC can be minimal, as for the largest workpiece WL, in that its sole purpose is to provide an over-center relationship to optimize gripping. With the foregoing parameters in mind, the location of pivot pin 38 and thus axis 40 is developed so as to determine a horizontal distance HD between point of contact PC7 and pivot axis 40. The pin location is based on calculations regarding different failure modes of pivot pin 38 including bearing, tensile and shear failure, and the loading of the pin for these calculations was taken for compliance with government specifications for pipe wrenches. Also taken into consideration in connection with these calculations is the need to maintain room for the portion of the handle that ultimately attaches the pivotal jaw to the pivot pin. Once the horizontal distance HD is determined for the largest workpiece WL, the fixed distance FD between axis 40 and vertex 32 of the pivotal jaw can be determined. In the embodiment herein illustrated and described, the latter distance is 2.840 inches. However, it will be understood that the latter dimension will vary depending on the largest workpiece which a wrench is designed to accommodate, the material from which the handle and jaw components are constructed, and design criteria which can vary from one manufacturer to the next with regard, for example, to the location of the pivot pin laterally of the handle, profiles of the component parts and the like. Once the location of the point of contact PC7 for the largest diameter workpiece is so determined, the location of a point of contact PC1 for the smallest diameter workpiece is determined by rotating jaw 22 counterclockwise 90° about pivot axis 40 which is to be the position of jaw 22 for gripping the smallest workpiece WS. Then, a line of action is provided for the latter workpiece which is between the workpiece center WC and pivot axis 40.

Figure 7:
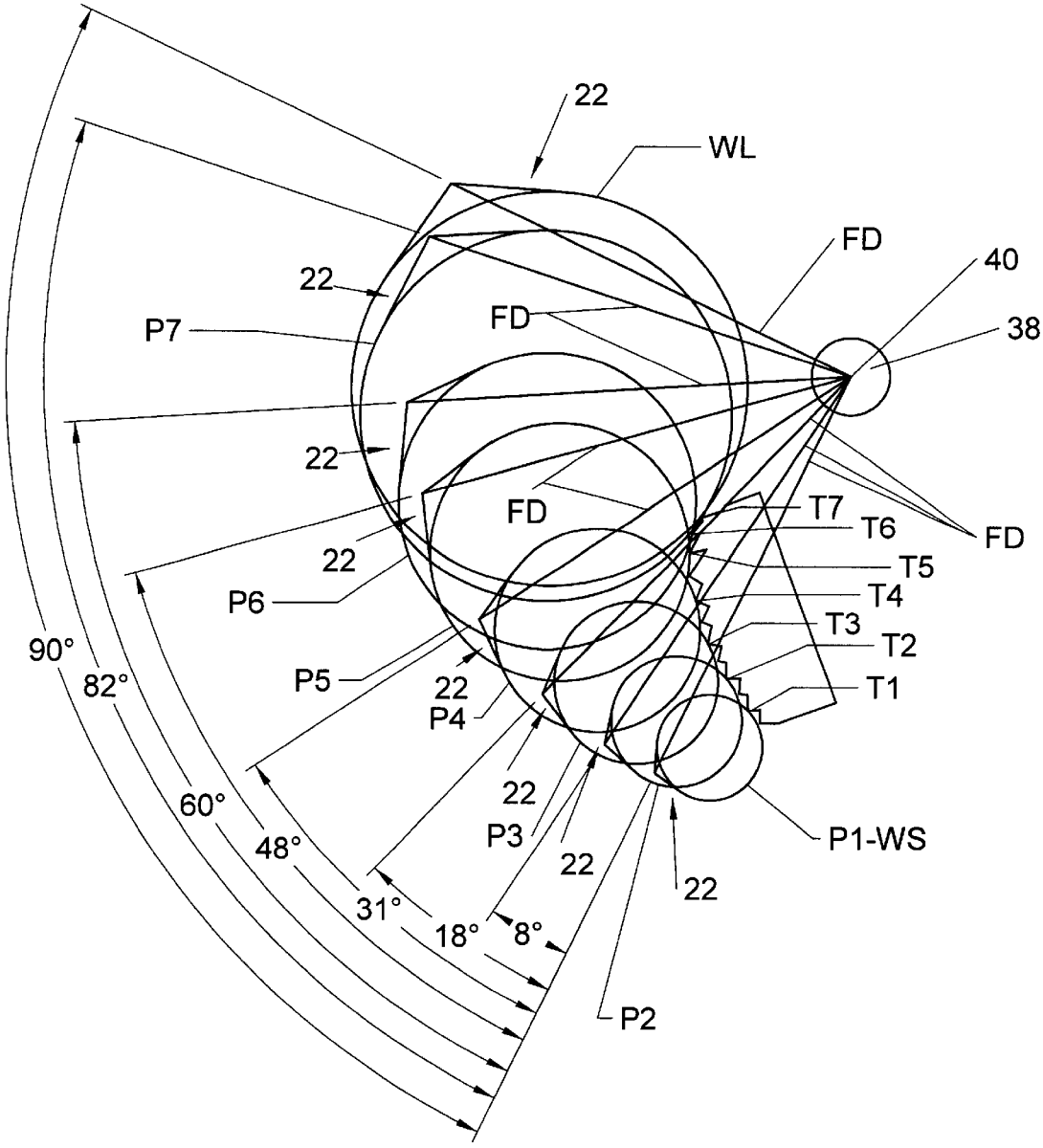
FIG. 7 schematically illustrates the rotational angles between the discrete teeth for the series of nominal pipe diameters.

The location of the discrete tooth along arcuate surface 34 of jaw member 18 for each workpiece between the smallest and largest workpiece diameters is achieved by rotating jaw member 22 for each subsequent workpiece size from the smallest WS an amount which is proportionate to the increase in workpiece size relative to the total 90° swing of the pivotal jaw. The degree of swing for the pivotal jaw for each workpiece size from WS is determined by the formula $$R = TR \times \frac{D1 - D2}{D3 - D2}$$

wherein R is the rotational angle of the pivotal jaw member, TR is the total rotation thereof about the jaw axis relative to the arcuate jaw, D1 is the outer diameter of the workpiece succeeding the workpiece corresponding to the preceeding discrete tooth, D2 is the outer diameter of the smallest of the plurality of workpieces to be gripped, and D3 is the outer diameter of the largest of the plurality of workpieces to be gripped. The degree of swing of jaw member 22 in this respect is shown schematically in FIG. 7, rounded off to the nearest degree. More particularly, the degree of swing between ⅜ inch pipe and ½ inch pipe is 8°, the degree of swing between ⅜ inch pipe and ¾ inch pipe is 18°, and so on. It will be appreciated from the above, that for each workpiece diameter, a point of contact with the arcuate jaw surface of heel jaw member 18 can be located. A discrete tooth is then positioned at the location to contact the corresponding workpiece, and the discrete tooth is oriented relative to the workpiece in a manner which optimizes gripping.

Figure 6A:
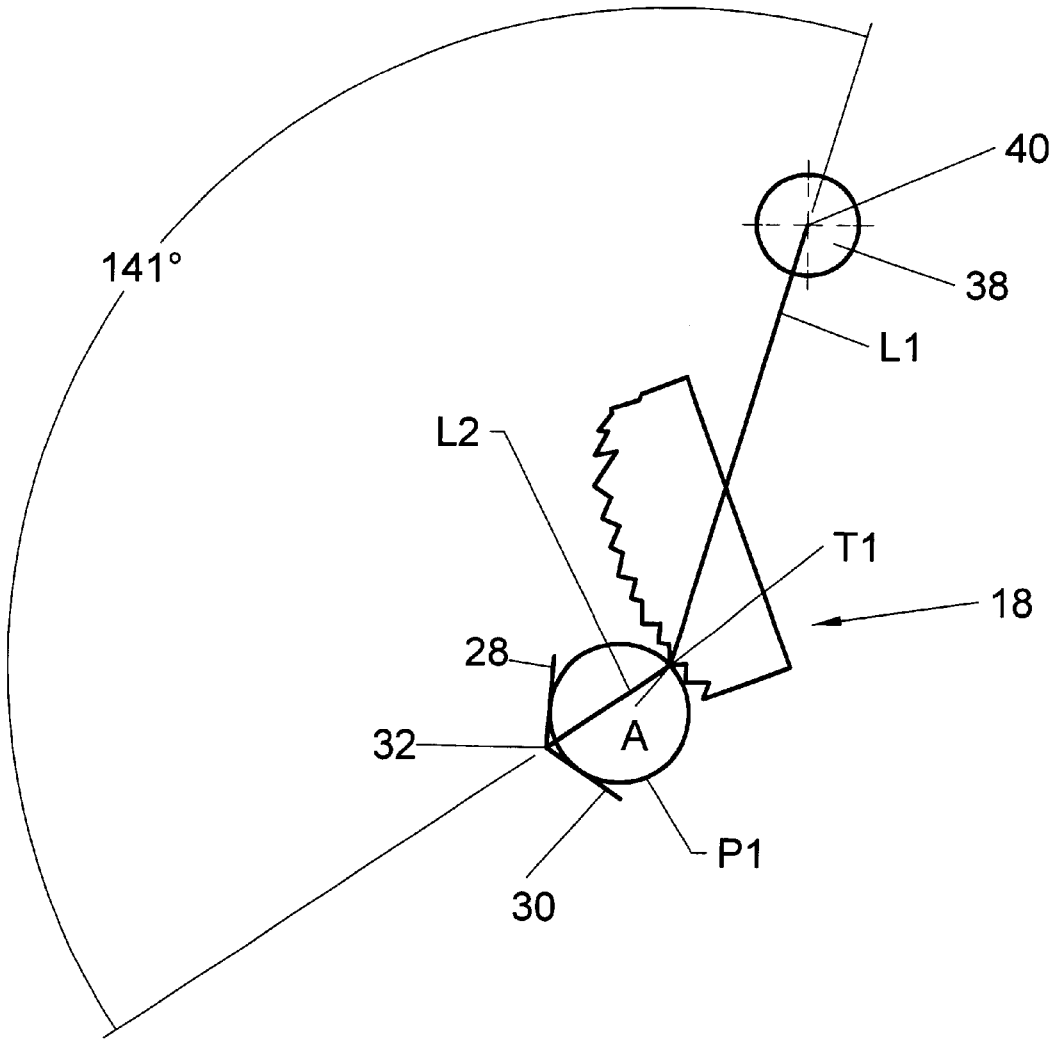
FIGS. 6A–G schematically illustrate the camming angles for a series of nominal pipe diameters.
Figure 6B:
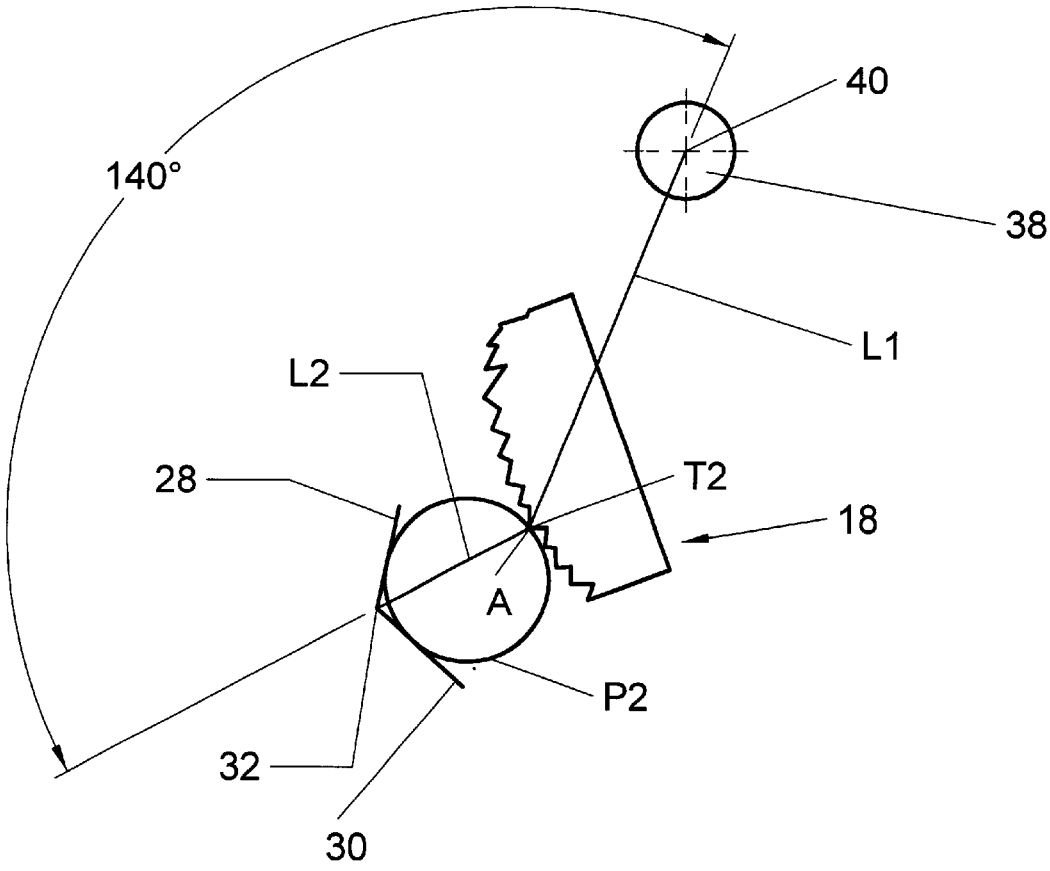
Figure 6C:
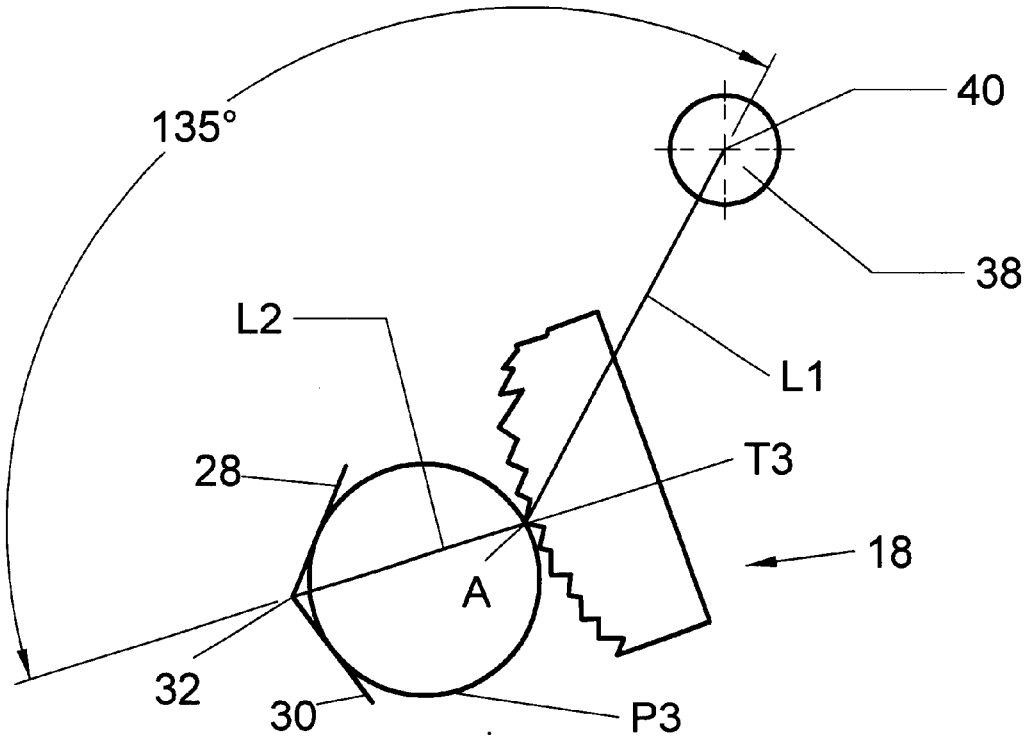
Figure 6D:
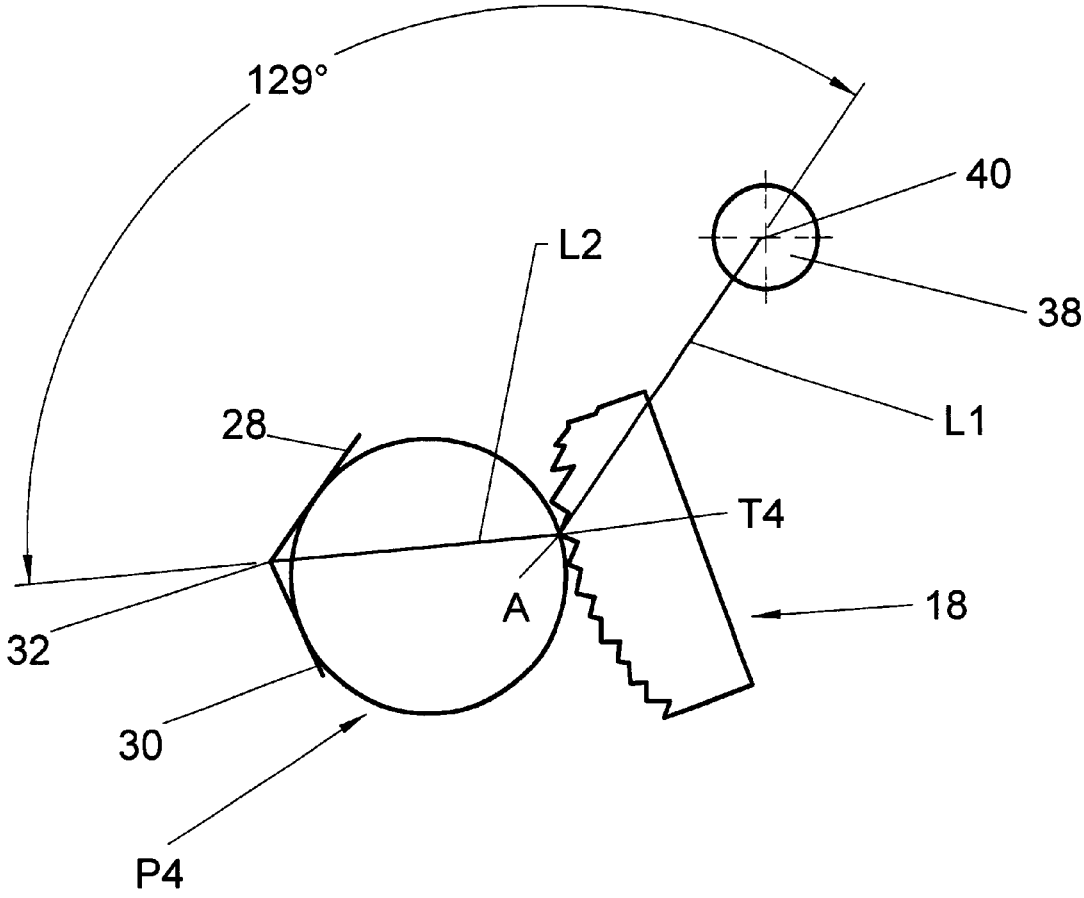
Figure 6E:
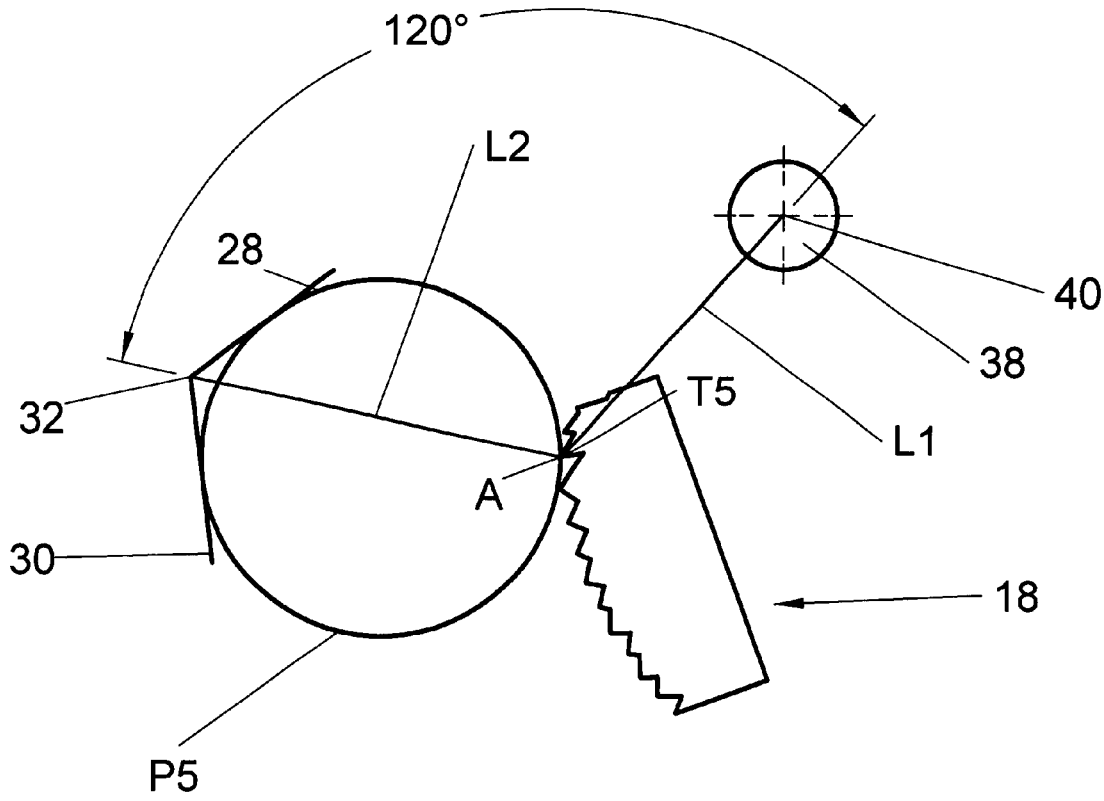
Figure 6F:
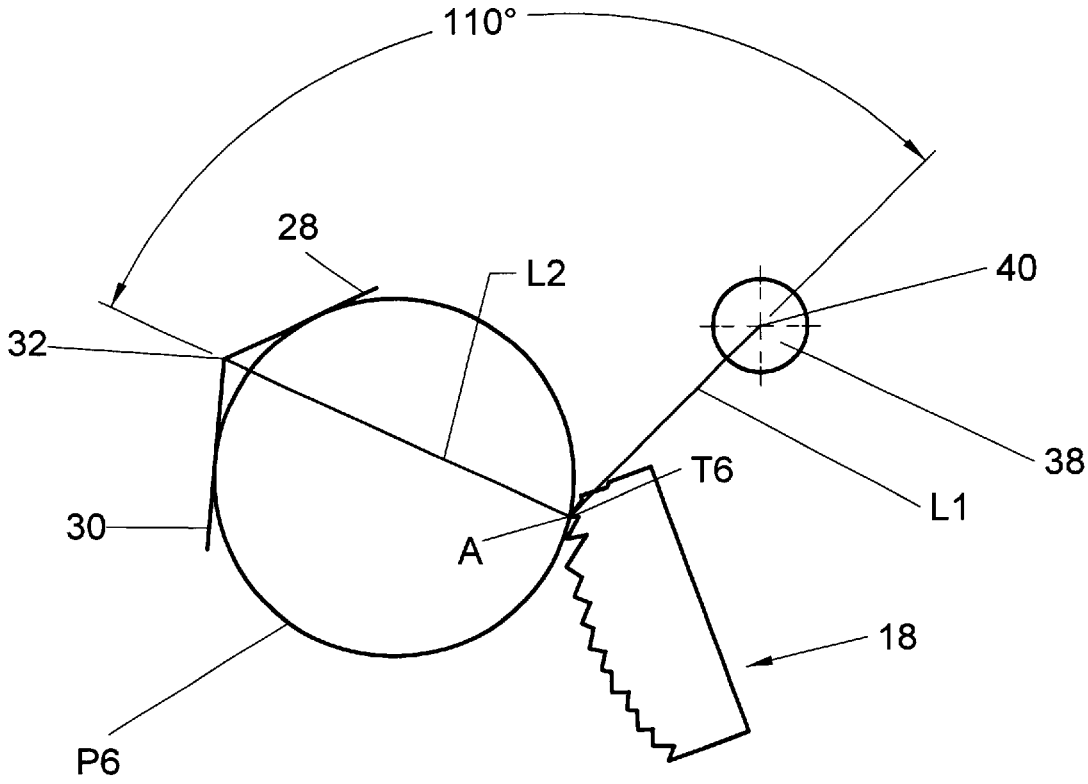
Figure 6G:
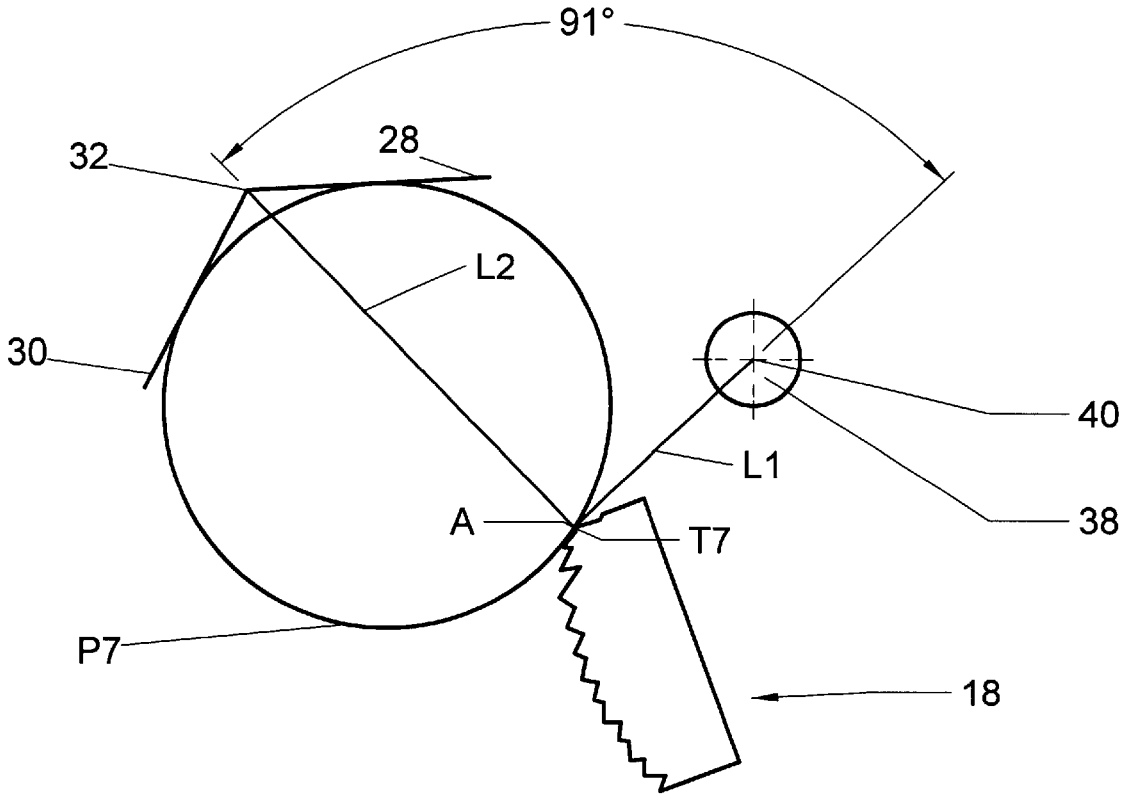

As mentioned hereinabove, the location of each of the discrete teeth along jaw surface 34 and the engagement of the corresponding pipe therewith and with teeth 28 and 30 of jaw member 22 provides a camming angle relative to the pipe and which, according to the invention, is maintained between 90° and 150° to optimize gripping of the corresponding pipe. The camming angles for each of the series of pipes referred to hereinabove are shown, sequentially, in FIGS. 6A–6G. With regard for example to FIG. 6A, the camming angle for a pipe P1 having a nominal size of ⅜ inch and an OD of 0.675 inch is defined by a line L1 through pivot axis 40 and apex A of discrete tooth T1 and a line L2 from apex A through vertex 32 between surfaces 28 and 30 of jaw member 22. As will be further appreciated from FIG. 6A, the camming angle for ⅜ inch nominal size pipe in accordance with the preferred embodiment is 141°. From the foregoing description of FIG. 6A, it will be appreciated that the camming angles illustrated in FIGS. 6B–6G are respectively for pipes P2–P7 having nominal dimensions of, sequentially, ½ inch, ¾ inch, 1 inch, 1¼ inches, 1½ inches, and 2 inches.

Figure 8A:
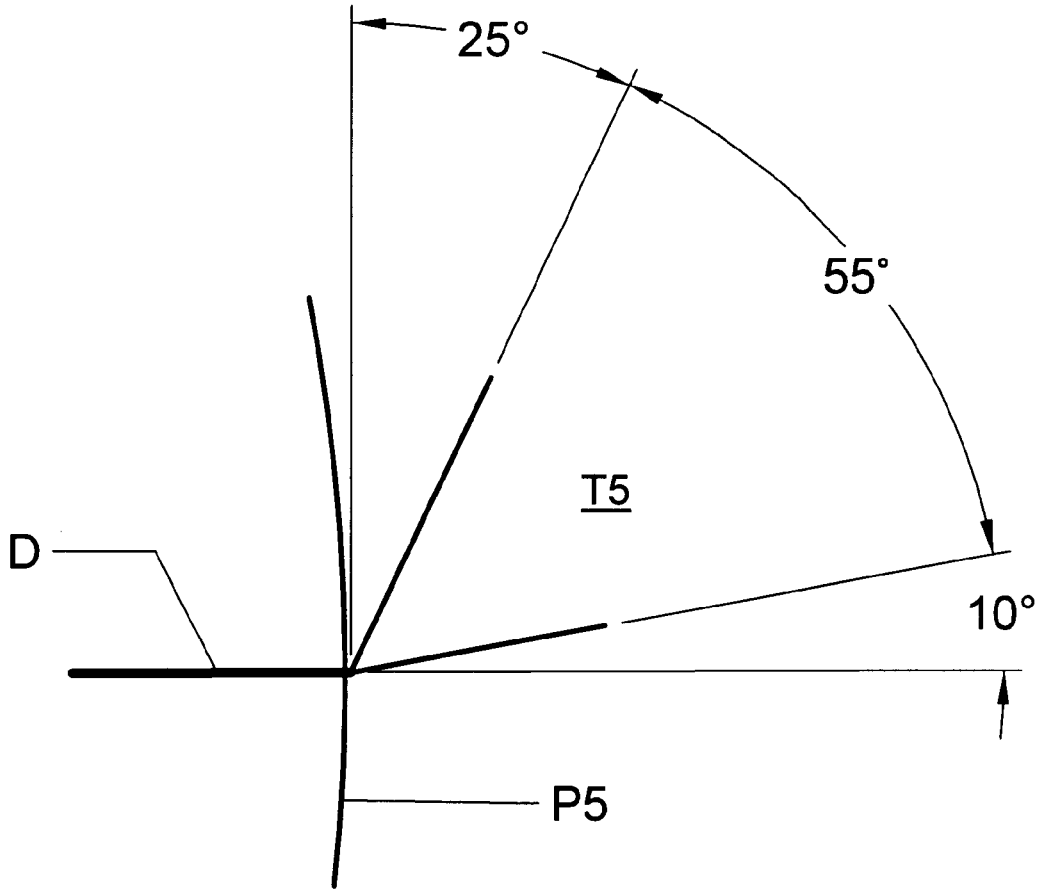
FIG. 8A schematically illustrates the tooth form and orientation for a discrete tooth and a camming angle of from 90° to 130°; and, FIG. 8B schematically illustrates the tooth form and orientation for a discrete tooth and a camming angle of from 131° to 150°.
Figure 8B:
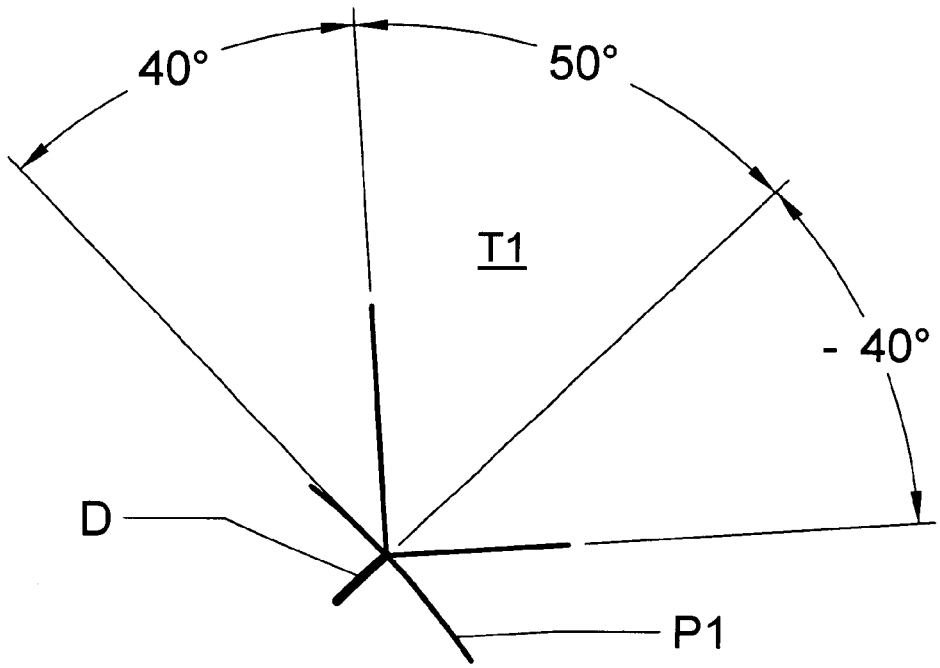

Further in connection with such positioning of a discrete tooth relative to the corresponding workpiece and maintaining a desired camming angle with respect thereto, a specific tooth configuration and orientation relative to the workpiece is preferably designed for each workpiece diameter. In this respect, different tooth profiles and orientations are provided for the discrete teeth with respect to which the camming angle is less than 130° and with respect to which the camming angle is greater than 130°. Accordingly, as will be appreciated from the schematic illustration in FIG. 8A with regard to pipe P5, discrete tooth T5 has an included angle of 55° and is oriented relative to a diametrical line D of pipe P5 so as to provide a rake angle of 10° and a relief angle of 25°. With regard to a camming angle greater than 130°, as schematically illustrated in FIG. 8B with regard to pipe P1, tooth T1 has an included angle of 90° and is oriented relative to diametrical line D of pipe P1 so as to have a relief angle of 40° and a rake angle of −40°. As mentioned hereinabove, an acceptable tolerance for each angle is ±5°.

While a specific series of workpiece diameters is referenced in connection with the embodiment of the present invention shown in FIGS. 1–8, it will be appreciated that the design criteria is applicable to pivoting jaw pipe wrenches for gripping pipe sizes smaller than ⅜ inch and greater than 2 inches. Further, while it is preferred that the acute angle between teeth 28 and 30 of the pivotal jaw member is nominally 120° to accommodate gripping fittings having hexagonal tool pad surfaces, it will be appreciated that other acute angles can be used without departing from the ability of the pivotal jaw to cradle a pipe and grip the latter relative to a discrete tooth therefor.

While considerable emphasis has been placed herein on the structures and structural interrelationships between the component parts of the preferred embodiments illustrated and described, it will be appreciated that other embodiments of the invention can be made and that many changes can be made in the preferred embodiments without departing from the principles of the invention. Accordingly, it is to be distinctly understood that the foregoing descriptive matter is to be interpreted merely as illustrative of the invention and not as a limitation.

Having thus described the invention, it is so claimed:

1. A wrench for gripping any one of a plurality of cylindrical workpieces having different diameters comprising, a handle having longitudinally opposite ends, a fixed jaw on one of said ends, said fixed jaw comprising a plurality of teeth laterally therealong and facing longitudinally outwardly of said one end, said teeth including a plurality of discrete teeth, each discrete tooth being for a different one of a plurality of cylindrical workpieces having different diameters, a pivotal jaw member having first and second jaw faces at an angle to one another and each including a plurality of teeth facing inwardly of said one end, said pivotal jaw member being mounted on said one end for displacement of said first and second jaw surfaces about a jaw axis toward and away from said fixed jaw, a workpiece of given diameter to be gripped by the wrench being cradled between said first and second jaw faces and engaged by the one of said plurality of discrete teeth provided on said fixed jaw for the workpiece of given diameter, and each of said discrete teeth having an apex and the apex of each discrete tooth being angularly offset from the apex of the preceding discrete tooth relative to said jaw axis by an angle R which is determined by the formula $$R = TR \times \frac{D1 - D2}{D3 - D2}$$

wherein TR is the total rotation of the pivoted jaw member about the jaw axis relative to the fixed jaw, D1 is the outer diameter of the workpiece succeeding the workpiece corresponding to the preceding discrete tooth, D2 is the outer diameter of the smallest of the plurality of workpieces to be gripped, and D3 is the outer diameter of the largest of the plurality of workpieces to be gripped.

2. A wrench according to claim 1, wherein, with the workpiece of given diameter gripped by the wrench, a line through said jaw axis and the apex of the one discrete tooth for the workpiece of given diameter and a line through the vertex of said first and second jaw faces and said apex of said one discrete tooth intersect to provide a camming angle therebetween of from 90° to 150°.

3. A wrench for gripping any one of a plurality of cylindrical workpieces having different diameters comprising, a handle having longitudinally opposite ends, a fixed jaw on one of said ends, said fixed jaw comprising a plurality of teeth laterally therealong and facing longitudinally outwardly of said one end, said teeth including a plurality of discrete teeth, each discrete tooth being for a different one of a plurality of cylindrical workpieces having different diameters, a pivotal jaw member having first and second jaw faces at an angle to one another and each including a plurality of teeth facing inwardly of said one end, said pivotal jaw member being mounted on said one end for displacement of said first and second jaw surfaces about a jaw axis toward and away from said fixed jaw, a workpiece of given diameter to be gripped by the wrench being cradled between said first and second jaw faces and engaged by the one of said plurality of discrete teeth provided on said fixed jaw for the workpiece of given diameter, and the one of said discrete teeth having an included angle of 55°, a relief angle of 25°and a rake angle of 10° relative to a line through the apex of the one discrete tooth and the center of the workpiece of given diameter.

4. A wrench for gripping any one of a plurality of cylindrical workpieces having different diameters comprising, a handle having longitudinally opposite ends, a fixed jaw on one of said ends, said fixed jaw comprising a plurality of teeth laterally therealong and facing longitudinally outwardly of said one end, said teeth including a plurality of discrete teeth, each discrete tooth being for a different one of a plurality of cylindrical workpieces having different diameters, a pivotal jaw member having first and second jaw faces at an angle to one another and each including a plurality of teeth facing inwardly of said one end, said pivotal jaw member being mounted on said one end for displacement of said first and second jaw surfaces about a jaw axis toward and away from said fixed jaw, a workpiece of given diameter to be gripped by the wrench being cradled between said first and second jaw faces and engaged by the one of said plurality of discrete teeth provided on said fixed jaw for the workpiece of given diameter, and the one of said discrete teeth having an included angle of 90°, a relief angle of 40° and a rake angle of −40° relative to a line through the apex of the one discrete tooth and the center of the workpiece of given diameter.

5. A wrench for gripping any one of a plurality of cylindrical workpieces having different diameters comprising, a handle having longitudinally opposite ends, a fixed jaw on one of said ends, said fixed jaw comprising a plurality of teeth laterally therealong and facing longitudinally outwardly of said one end, said teeth including a plurality of discrete teeth, each discrete tooth being for a different one of a plurality of cylindrical workpieces having different diameters, a pivotal jaw member having first and second jaw faces at an angle to one another and each including a plurality of teeth facing inwardly of said one end, said pivotal jaw member being mounted on said one end for displacement of said first and second jaw surfaces about a jaw axis toward and away from said fixed jaw, a workpiece of given diameter to be gripped by the wrench being cradled between said first and second jaw faces and engaged by the one of said plurality of discrete teeth provided on said fixed jaw for the workpiece of given diameter, each of said discrete teeth having an apex and said pivotal jaw member having a vertex between said first and second jaw faces and, with the workpiece of given diameter gripped by the wrench, a line through said jaw axis and the apex of the one discrete tooth for the workpiece of given diameter and a line through said vertex and said apex of the one discrete tooth intersecting to provide a camming angle therebetween of from 90° to 150°, and the discrete teeth corresponding to a camming angle of from 90° to 130° having an included angle of 55°, a relief angle of 25° and a rake angle of 10° relative to a line through the apex of each corresponding discrete tooth and the center of the workpiece of given diameter for the corresponding tooth.

6. A wrench according to claim 5, wherein each of said discrete teeth has an apex and the apex of each discrete tooth is angularly offset from the apex of the preceding discrete tooth relative to said jaw axis by an angle R which is determined by the formula $$R = TR \times \frac{D1 - D2}{D3 - D2}$$

wherein TR is the total rotation of the pivotal jaw member about the jaw axis relative to the arcuate jaw, D1 is the outer diameter of the workpiece succeeding the pipe corresponding to the preceding discrete tooth, D2 is the outer diameter of the smallest of the plurality of workpieces to be gripped, and D3 is the outer diameter of the largest of the plurality of workpieces to be gripped.

7. A wrench for gripping any one of a plurality of cylindrical workpieces having different diameters comprising, a handle having longitudinally opposite ends, a fixed jaw on one of said ends, said fixed jaw comprising a plurality of teeth laterally therealong and facing longitudinally outwardly of said one end, said teeth including a plurality of discrete teeth, each discrete tooth being for a different one of a plurality of cylindrical workpieces having different diameters, a pivotal jaw member having first and second jaw faces at an angle to one another and each including a plurality of teeth facing inwardly of said one end, said pivotal jaw member being mounted on said one end for displacement of said first and second jaw surfaces about a jaw axis toward and away from said fixed jaw, a workpiece of given diameter to be gripped by the wrench being cradled between said first and second jaw faces and engaged by the one of said plurality of discrete teeth provided on said fixed jaw for the workpiece of given diameter, each of said discrete teeth having an apex and said pivotal jaw member having a vertex between said first and second jaw faces and, with the workpiece of given diameter gripped by the wrench, a line through said jaw axis and the apex of the one discrete tooth for the workpiece of given diameter and a line through said vertex and said apex of the one discrete tooth intersecting to provide a camming angle therebetween of from 90° to 150° and the discrete teeth corresponding to a camming angle of 131° to 150° having an included angle of 90°, a relief angle of 40° and a rake angle of 40° relative to a line through the apex of each corresponding discrete tooth and the center of the workpieces of given diameter for the corresponding tooth.

8. A wrench according to claim 7, wherein each of said discrete teeth has an apex and the apex of each discrete tooth is angularly offset from the apex of the preceding discrete tooth relative to said jaw axis by an angle R which is determined by the formula $$R = TR \times \frac{D1 - D2}{D3 - D2}$$

wherein TR is the total rotation of the pivotal jaw member about the jaw axis relative to the arcuate jaw, D1 is the outer diameter of the workpiece succeeding the pipe corresponding to the preceding discrete tooth, D2 is the outer diameter of the smallest of the plurality of workpieces to be gripped, and D3 is the outer diameter of the largest of the plurality of workpieces to be gripped.

9. A wrench according to claim 7, wherein the discrete teeth corresponding to a camming angle of from 90° to 130° have an included angle of 55°, a relief angle of 25° and a rake angle of 10° relative to a line through the apex of each corresponding discrete tooth and the center of the workpiece of given diameter for the corresponding tooth.

10. A wrench according to claim 9, wherein each of said discrete teeth has an apex and the apex of each discrete tooth is angularly offset from the apex of the preceding discrete tooth relative to said jaw axis by an angle R which is determined by the formula $$R = TR \times \frac{D1 - D2}{D3 - D2}$$

wherein TR is the total rotation of the jaw member about the jaw axis relative to the arcuate jaw, D1 is the outer diameter of the pipe succeeding the pipe corresponding to the preceding discrete tooth, D2 is the outer diameter of the smallest of the plurality of workpieces to be gripped, and D3 is the outer diameter of the largest of the plurality of workpieces to be gripped.

11. A wrench according to claim 10, wherein said plurality of teeth laterally along said fixed jaw includes teeth laterally between adjacent ones of said discrete teeth.

12. A wrench for gripping any one of a plurality of cylindrical workpieces having different diameters comprising, a handle having longitudinally opposite ends, a fixed jaw on one of said ends, said fixed jaw comprising a plurality of teeth laterally therealong and facing longitudinally outwardly of said one end, said teeth including a plurality of discrete teeth, each discrete tooth being for a different one of a plurality of cylindrical workpieces having different diameters, a pivotal jaw member having first and second jaw faces at an angle to one another and each including a plurality of teeth facing inwardly of said one end, said pivotal jaw member being mounted on said one end for displacement of said first and second jaw surfaces about a jaw axis toward and away from said fixed jaw, a workpiece of given diameter to be gripped by the wrench being cradled between said first and second jaw faces and engaged by the one of said plurality of discrete teeth provided on said fixed jaw for the workpiece of given diameter, each of said discrete teeth having an apex and said pivotal jaw member having a vertex between said first and second jaw faces and, with the workpiece of given diameter gripped by the wrench, a line through said jaw axis and the apex of the one discrete tooth for the workpiece of given diameter and a line through said vertex and said apex of the one discrete tooth intersecting to provide a camming angle therebetween of from 90° to 150°, and said plurality of teeth laterally along said fixed jaw including teeth laterally between adjacent ones of said discrete teeth.

13. A wrench according to claim 12 wherein the angle between said first and second jaw faces is between 90° and 130°.

14. A wrench according to claim 13 wherein said angle is 119°.

15. A wrench according to claim 13 wherein each of said discrete teeth has an apex and said pivotal jaw member has a vertex between said first and second jaw faces and wherein, with the workpiece of given diameter gripped by the wrench, a line through said jaw axis and the apex of the one discrete tooth for the workpiece of given diameter and a line through said vertex and said apex of the one discrete tooth intersect to provide a camming angle therebetween of from 90° to 150°.

16. A wrench for gripping any one of a plurality of cylindrical workpieces having different diameters comprising, a handle having longitudinally opposite ends, a fixed jaw on one of said ends, said fixed jaw comprising a plurality of teeth laterally therealong and facing longitudinally outwardly of said one end, said teeth including a plurality of discrete teeth, each discrete tooth being for a different one of a plurality of cylindrical workpieces having different diameters, a pivotal jaw member having first and second jaw faces at an angle to one another and each including a plurality of teeth facing inwardly of said one end, said pivotal jaw member being mounted on said one end for displacement of said first and second jaw surfaces about a jaw axis toward and away from said fixed jaw, a workpiece of given diameter to be gripped by the wrench being cradled between said first and second jaw faces and engaged by the one of said plurality of discrete teeth provided on said fixed jaw for the workpiece of given diameter, each of said discrete teeth having an apex and said pivotal jaw member having a vertex between said first and second jaw faces and, with the workpiece of given diameter gripped by the wrench, a line through said jaw axis and the apex of the one discrete tooth for the workpiece of given diameter and a line through said vertex and said apex of the one discrete tooth intersecting to provide a camming angle therebetween of from 90° to 150°, and the discrete teeth corresponding to a camming angle of from 90° to 130° having an included angle of 55°, a relief angle of 25° and rake angle of 10° relative to a line through the apex of each corresponding discrete tooth and the center of the workpiece of given diameter for the corresponding tooth.

17. A wrench for gripping any one of a plurality of cylindrical workpieces having different diameters comprising, a handle having longitudinally opposite ends, a fixed jaw on one of said ends, said fixed jaw comprising a plurality of teeth laterally therealong and facing longitudinally outwardly of said one end, said teeth including a plurality of discrete teeth, each discrete tooth being for a different one of a plurality of cylindrical workpieces having different diameters, a pivotal jaw member having first and second jaw faces at an angle to one another and each including a plurality of teeth facing inwardly of said one end, said pivotal jaw member being mounted on said one end for displacement of said first and second jaw surfaces about a jaw axis toward and away from said fixed jaw, a workpiece of given diameter to be gripped by the wrench being cradled between said first and second jaw faces and engaged by the one of said plurality of discrete teeth provided on said fixed jaw for the workpiece of given diameter, the angle between said first and second jaw faces being between 90° and 130°, each of said discrete teeth having an apex and said pivotal jaw member having a vertex between said first and second jaw faces and, with the workpiece of given diameter gripped by the wrench, a line through said jaw axis and the apex of the one discrete tooth for the workpiece of given diameter and a line through said vertex and said apex of the one discrete tooth intersecting to provide a camming angle therebetween of from 90° to 150°, the discrete teeth corresponding to a camming angle of 131° to 150° having an included angle of 90°, a relief angle of 40° and a rake angle of −40° relative to a line through the apex of each corresponding discrete tooth and the center of the workpiece of given diameter for the corresponding tooth.

18. A wrench according to claim 17, wherein the discrete teeth corresponding to a camming angle of from 90° to 130° have an included angle of 55°, a relief angle of 25° and a rake angle of 10° relative to a line through the apex of each corresponding discrete tooth and the center of the workpiece of given diameter for the corresponding tooth.

19. A wrench according to claim 18, wherein each of said discrete teeth has an apex and the apex of each discrete tooth is angularly offset from the apex of the preceding discrete tooth relative to said jaw axis by an angle R which is determined by the formula $$R = TR \times \frac{D1 - D2}{D3 - D2}$$

wherein TR is the total rotation of the pivotal jaw member about the jaw axis relative to the arcuate jaw, D1 is the outer diameter of the workpiece succeeding the workpiece corresponding to the preceding discrete tooth, D2 is the outer diameter of the smallest of the plurality of workpieces to be gripped, and D3 is the outer diameter of the largest of the plurality of workpieces to be gripped.

20. A wrench according to claim 19, wherein said plurality of teeth laterally along said arcuate jaw includes teeth laterally between adjacent ones of said discrete teeth.

21. A wrench according to claim 19, wherein said angle is 119°.

22. A wrench according to claim 20, wherein said plurality of teeth laterally along said arcuate jaw includes teeth laterally between adjacent ones of said discrete teeth.

* * * * *